US007518124B2

(12) United States Patent
Goldberg

(10) Patent No.: US 7,518,124 B2
(45) Date of Patent: Apr. 14, 2009

(54) MONATOMIC DOPANT ION SOURCE AND METHOD

(75) Inventor: Richard David Goldberg, Hove (GB)

(73) Assignee: Applied Materials, Inc., Santa Clara, CA (US)

( * ) Notice: Subject to any disclaimer, the term of this patent is extended or adjusted under 35 U.S.C. 154(b) by 372 days.

(21) Appl. No.: 11/528,371

(22) Filed: Sep. 28, 2006

(65) Prior Publication Data

US 2007/0075267 A1 Apr. 5, 2007

Related U.S. Application Data

(63) Continuation-in-part of application No. 11/132,437, filed on May 19, 2005, now abandoned, which is a continuation-in-part of application No. 10/394,665, filed on Mar. 24, 2003, now Pat. No. 6,905,947.

(30) Foreign Application Priority Data

Mar. 28, 2002 (GB) ..... 0207398.9

(51) Int. Cl.
*H01J 27/00* (2006.01)

(52) U.S. Cl. ..... 250/426; 250/427; 250/423 R; 250/492.21; 250/492.2; 438/510; 438/513; 438/514; 438/515; 427/523; 315/111.81; 313/363.1

(58) Field of Classification Search ..... 250/492.21, 250/423 R, 426, 427, 492.2; 438/510, 513, 438/514, 515; 427/523; 315/111.81; 313/363.1

See application file for complete search history.

(56) References Cited

U.S. PATENT DOCUMENTS

| | | | | |
|---|---|---|---|---|
| 4,957,773 | A | 9/1990 | Spencer et al. | |
| 5,013,604 | A * | 5/1991 | Allen et al. | 428/402 |
| 6,013,332 | A * | 1/2000 | Goto et al. | 427/530 |
| 6,288,403 | B1 | 9/2001 | Horsky | |
| 6,452,338 | B1 | 9/2002 | Horsky | |
| 6,479,828 | B2 | 11/2002 | Perel | |
| 6,770,874 | B2 * | 8/2004 | Dykstra | 250/287 |
| 6,905,947 | B2 * | 6/2005 | Goldberg | 438/513 |
| 2001/0017109 | A1 * | 8/2001 | Liu et al. | 118/723 I |
| 2002/0070672 | A1 * | 6/2002 | Horsky | 315/111.81 |
| 2002/0074521 | A1 * | 6/2002 | Perel | 250/492.21 |
| 2005/0274903 | A1 * | 12/2005 | Goldberg | 250/423 R |

FOREIGN PATENT DOCUMENTS

| | | |
|---|---|---|
| JP | 580133368 | 9/1983 |

* cited by examiner

*Primary Examiner*—Jack I Berman
*Assistant Examiner*—Michael J Logie
(74) *Attorney, Agent, or Firm*—Boult Wade Tennant

(57) ABSTRACT

Monotomic dopant ions for ion implantation are supplied from vapour of a species containing plural atoms of the desired dopant. The vapour is fed to a plasma chamber and a plasma produced in the chamber with sufficient energy density to disassociate the vapour species to produce monatomic dopant ions in the plasma for implantation.

33 Claims, 2 Drawing Sheets

MONATOMIC DOPANT ION SOURCE AND METHOD

CROSS REFERENCE TO RELATED APPLICATION

This is a continuation-in-part of U.S. application Ser. No. 11/132,437, filed May 19, 2005, which was a continuation-in-part of application Ser. No. 10/394,665, filed Mar. 24, 2003, now U.S. Pat. No. 6,905,947.

FIELD OF THE INVENTION

This invention relates to a source of, and a method of providing, monatomic ions of a desired dopant for ion implantation.

BACKGROUND OF THE INVENTION

Known dopants used for modifying the conductivity of semiconductor materials in the manufacture of integrated electronic circuits include Arsenic (As), Antimony (Sb), Indium (In), Phosphorus (P) and Boron (B). A typical ion source used for generating an ion beam containing monatomic ions uses a feed gas or vapour to the usual plasma chamber of the ion source, the feed gas or vapour containing a species comprising a single atom of the desired dopant, usually as a compound such as $BF_3$. In the ion source, the $BF_3$ gas is dissociated in the plasma to form $B^+$ ions, often as well as $BF^+$ and $BF_2^+$. The ion beam extracted from the ion source is passed through a mass analyser to select the $B^+$ ions for onward transmission for implanting in the semiconductor wafer target. Similar dissociation and mass selection is applied to other feed species for other dopants.

It is also known to use large species, such as decaborane ($B_{10}H_{14}$), containing multiple atoms of the desired dopant, as a feed stock for an ion source in ion implantation. Decaborane, for example, is used to produce ions each comprising up to 10 boron atoms. Such $B_xH_y^+$ ions can be used to implant boron atoms at relatively low energies.

Decaborane Ion Implantation by Perel et al, IIT 2000, pp. 304 to 307, discloses the spectrum of ion masses which may be generated from a suitably controlled ion source employing decaborane as feed stock. Ions having masses corresponding to the presence of 10 boron atoms are selected in a mass analyser for implantation.

U.S. Pat. No. 6,288,403 discloses an ion source adapted for the preferential production of decaborane ions, particularly for low energy implantation.

SUMMARY OF THE INVENTION

The present invention provides a method of providing monatomic ions of a desired dopant for ion implantation, comprising supplying a feed vapour into a plasma chamber, said feed vapour containing a species each comprising a plural number of atoms of the desired dopant, generating a plasma in said plasma chamber having a sufficient energy density to disassociate said species to produce monatomic ions of said desired dopant in the plasma, wherein a plasma supporting gas, different from said feed vapour, is supplied at least initially when the plasma is first established in the plasma chamber, the rate of supply of the supporting gas being reduced when the plasma chamber reaches a desired temperature.

In the present invention, the feed vapour containing multiple ions of the dopant is fed to the plasma chamber in order to provide a supply of monatomic ions of the dopant in the plasma to enhance the current of the monatomic ions which can be extracted from the source. At least initially, a different plasma supporting gas may be supplied to the plasma chamber of the ion source, such as $BF_3$ or Ar. The plasma supporting gas allows a stable plasma to be established initially in the plasma chamber. When the plasma chamber is hot enough, the flow of supporting gas can be backed off in favour of the feed vapour. A relatively high energy density plasma is maintained within the plasma chamber and the feed vapour provided in the plasma chamber is then dissociated in the plasma to provide monatomic ions of the dopant for inclusion in the extracted ion beam.

The invention also provides a source of monatomic ions of a desired dopant for an ion implanter, comprising a plasma chamber, a feed vapour supply, said feed vapour containing a species each comprising a plural number of atoms of the desired dopant, a supply of a plasma supporting gas, other than said feed vapour, an energy supply to said plasma chamber to form a plasma therein having an energy density sufficient to dissociate said species to produce monatomic ions of said desired dopant, and a controller to control said feed vapour supply and said supporting gas supply to provide a simultaneous supply to the plasma chamber of said feed vapour and said supporting gas.

The species used in the feed vapour should be one that has a substantial vapour pressure above a first predetermined temperature and dissociates above a second predetermined temperature higher than said first predetermined temperature. Then it is convenient to ensure that a feed conduit of the feed vapour supply to the plasma chamber is cooled so that the feed vapour is kept below said second predetermined temperature before entering the plasma chamber. This helps prevent dissociation of the feed vapour before entering the plasma chamber and reduces deposition of the dissociation products in the feed conduit. The energy supply to the plasma chamber and the plasma chamber itself should ensure that the plasma chamber operates above said second predetermined temperature.

Normally, the ion source is used in combination with a mass selector set up to form a beam of the monatomic ions of the desired dopant ions for transmission to the substrate to be implanted.

BRIEF DESCRIPTION OF THE DRAWING

An example of the invention will now be described with reference to the accompanying drawings.

DETAILED DESCRIPTION OF THE PREFERRED EMBODIMENT

Figure 1:
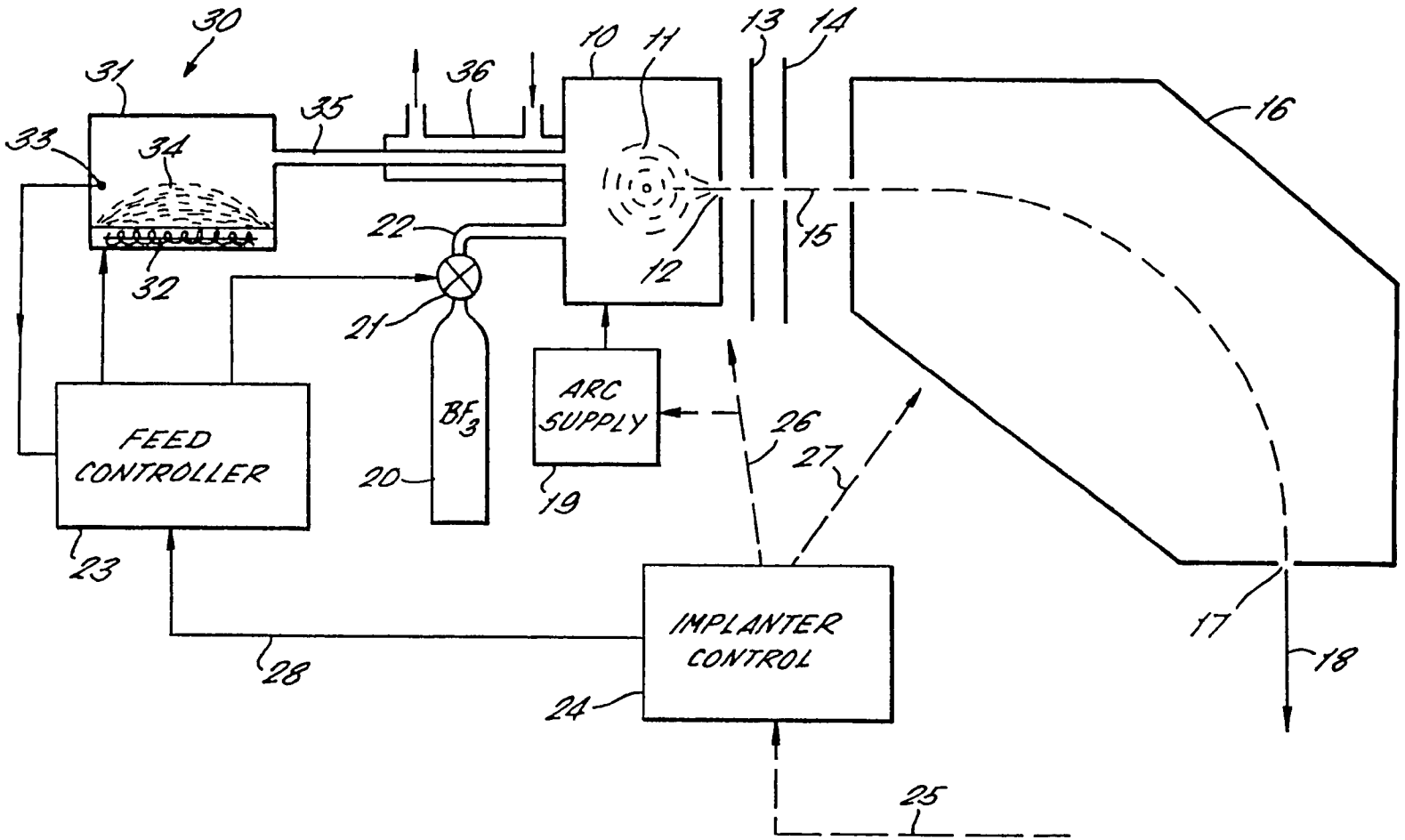
FIG. 1 is a schematic diagram of an ion source embodying the invention and in combination with a mass selector.

Referring to the drawing, an ion source has a plasma chamber 10 in which feed gas is ionised to form a plasma 11 containing ions of an atomic species to be implanted in a substrate (not shown). Ions are extracted from the plasma chamber 10 through an extraction aperture 12, by means of an extraction electric field formed by suitably biased extraction electrodes 13, 14. The extracted ions are accelerated by electrodes 13 and 14 to form an ion beam 15 which is directed into a mass analyser 16. The mass analyser may, in accordance with known practice, be a magnetic sector analyser, in which ions, entering the analyser 16 with the selected momentum, pass through the analyser in a path with a curvature such that the selected ions pass through a mass selection slit 17 at the exit of the analyser, to form a beam of mass selected ions 18, for onward transmission to a process station of an ion implanter which is not shown in this drawing.

The plasma chamber 10 may be a DC arc type plasma chamber, in which energy is delivered to maintain the plasma in the chamber, from an arc supply 19. The arc chamber arrangement may, for example, be the well known Bernas-type, in which thermionic electrons emitted by a cathode in the chamber are confined to an axial region of the arc chamber by means of an applied magnetic field.

Feed gas is supplied to the arc chamber 10 to maintain a desired partial pressure within the arc chamber sufficient to support plasma 11. In known ion sources, a beam of boron ions is produced by feeding $BF_3$ gas to the arc chamber. Within the arc chamber the arc supply 19 is controlled to generate a plasma of sufficient energy density to dissociate the $BF_3$ molecules and to form within the plasma ions of $B^+$, as well as $BF^+$, and possibly $BF_2^+$. If it is desired that beam 18, for transmission to the implant process chamber, is a beam of $B^+$ ions, the mass analyser 16 is set to reject other ions generated in the arc chamber and extracted in the initial beam 15. Clearly, in order to maximise the $B^+$ current in beam 18 from the mass selector, the arc chamber 10 is operated to maximise the proportion of $B^+$ ions in the plasma 11.

In accordance with standard practice, the $BF_3$ feed gas supply to arc chamber 10 comprises a gas bottle 20 connected via a control valve 21 and a feed conduit 22, into the interior of the plasma chamber 10. The rate of supply of $BF_3$ gas to the arc chamber 10 is controlled by the control valve 21 under the supervision of feed gas supply controller 23. The feed gas supply controller 23 itself receives supervisory control data from an implanter control system 24, which receives various sense parameter data from the implanter system over a generalised input line 25, and supplies control parameter data to control the overall functioning of the implanter, over generalised output control lines 26, 27, as well as control line 28 to the feed controller 23.

In addition to the $BF_3$ gas supply illustrated in the Figure, the described example of the invention includes a decaborane vapour supply, indicated generally at 30. The decaborane vapour supply 30 comprises an oven 31 fitted with a heater 32, the heat output of which is controlled by the feed controller 23 in response to temperature feedback, from temperature sensor 33.

The oven 31 contains a mass of decaborane powder 34 which is heated to a temperature at which the decaborane powder sublimes to provide a desired decaborane vapour pressure. Decaborane vapour is fed along conduit 35 from the oven 31 to supply the decaborane vapour to the interior of the arc chamber 10.

A vapour supply control valve, not shown in the figure, may also be included in the vapour conduit 35, to control the rate of flow of vapour from the oven 31 into the arc chamber 10. The control valve is then subject also to control by the feed controller 23.

Decaborane powder has a vapour pressure of the order of 0.1 Torr at room temperature, and produces a substantial vapour pressure at temperatures above 100° C. However, at temperatures much above 300° C., the decaborane molecule tends to dissociate. Within the arc chamber 10, the walls of the arc chamber may be at temperatures of between 500° C. and as much as 1000° C. Furthermore, the arc supply 19 is such that the plasma 11 has an energy intensity which would tend to dissociate substantially all decaborane molecules within the plasma region. The resulting increased number of monatomic boron atoms substantially boosts the monatomic boron ion concentration within the plasma 11, permitting the extraction of relatively higher monatomic boron ion currents from the plasma chamber 10, resulting in an increase in the $B^+$ current in mass selected beam 18.

As mentioned above, the decaborane molecule is unstable at temperatures above about 300° C. At such higher temperatures, the molecule dissociates and the resulting fragment molecules, including monatomic boron, have a much lower vapour pressure at those temperatures and therefore tend to deposit out as solid boron. In order to prevent decaborane vapour from dissociating and depositing out within the conduit 35, the conduit 35 is cooled, especially at its connection with the plasma chamber 10, by means of a cooling jacket 36. The coolant may be water. The cooling jacket 36 is controlled to ensure that the conduit 35 is held at a sufficient temperature to maintain the required vapour pressure of decaborane, but below the temperature (about 300° C.) at which the decaborane tends to dissociate. In this way, the decaborane vapour can be fed directly into the interior of the plasma chamber 10 without dissociating, thereby ensuring a proper supply of the decaborane into the plasma chamber and avoiding deposition of decaborane products within the conduit 35.

Inside the plasma chamber 10, the decaborane vapour quickly dissociates to enrich the $B^+$ content of the plasma 11.

In operating the plasma chamber 10 with decaborane vapour feed as described above, the arc within the chamber 10 is first formed using $BF_3$ feed alone at a predetermined rate of supply. Then decaborane vapour is added to the feed to produce the desired $B^+$ enrichment of the plasma. The rate of supply of $BF_3$ gas may then be reduced. In order to maintain a stable plasma of substantial energy density within the chamber 10, some $BF_3$ gas may be supplied continuously simultaneously with the decaborane vapour.

However, in some arrangements it may be possible to reduce the second rate of $BF_3$ supply to zero and to run the plasma on decaborane vapour alone.

A primary function of the $BF_3$ feed gas is to facilitate starting the plasma and then, when supplied simultaneously with decaborane vapour, to maintain plasma stability. This functionality could be achieved by alternate supporting gases compatible with the desired process. For example the decaborane vapour could be run simultaneously with argon gas, where the argon provides plasma stability and the decaborane vapour enriches the plasma with $B^+$ ions.

The feed gas supply controller 23 may be arranged to optimise the ratio of supply of the decaborane vapour and the plasma supporting gas such as $BF_3$, so as to maximise the $B^+$ current in the extracted beam, while controlling or limiting the deposition of boron in the plasma chamber and ensuring a stable plasma. It may also be feasible to switch from $BF_3$ gas to decaborane vapour when the plasma chamber reaches a desired operating temperature with no significant period of simultaneous supply of both the plasma support gas (e.g. $BF_3$) and the feed vapour (e.g. $B_{10}H_{14}$).

In the described example, the plasma chamber 10 is constituted by a cathode arc chamber, and the plasma generating energy is derived from an arc supply 19. Instead, the energy required to create the plasma within the plasma chamber can be derived from other sources, including radio frequency or microwave sources. Any suitable arrangement may be employed for extracting ions from the plasma chamber including a so-called tetrode system with four electrodes including the front face of the plasma chamber with the extraction aperture.

Also, although a single aperture 12 for extraction of the plasma to form the ion beam 15 is illustrated in the drawing, multiple apertures may be provided, for example for enhancing the total beam current drawn from the chamber. Further, the disclosed magnetic sector analyser 16 is just one form of mass analyser which may be used with the described system.

Figure 2:
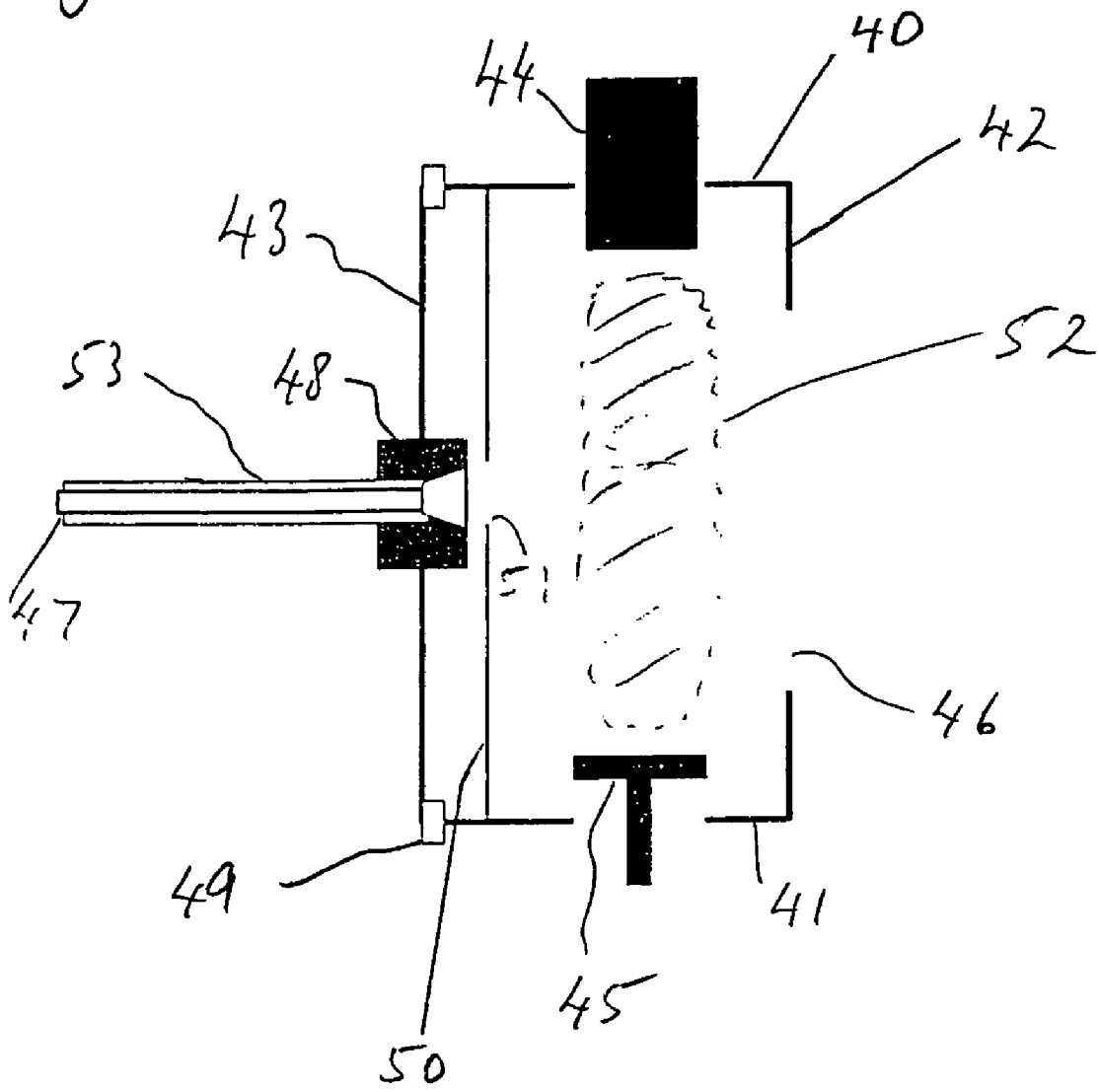
FIG. 2 is a schematic diagram of the plasma chamber of the ion source of FIG. 1.

FIG. 2 illustrates in greater detail an embodiment of plasma chamber, including parts of a feed vapour supply. The plasma chamber is generally cuboidal in form comprising containing walls including top and bottom walls 40 and 41, side walls not shown in the Figure, being parallel to the plane of the paper, a front wall 42 and a rear wall 43. The illustrated plasma chamber is of the Bernas type with an indirectly heated cathode having a heated cathode 44 mounted through the upper wall 40, and an electron reflecting electrode 45 mounted through the lower wall 41. Magnetic poles, not shown, provide a magnetic field aligned between the electrodes 44 and 45, to constrain electrons emitted by the cathode 44 to an axial region between the cathode 44 and reflecting electrode 45. This is the plasma-forming region within the plasma chamber. Ions formed in the plasma when the chamber is in operation are extracted by external electrodes, also not shown, through an aperture 46 in the front wall 42 of the chamber, to form the required ion beam. Feed gas or vapour can be fed to the plasma chamber through a conduit 47 connected to a nozzle 48 mounted in the rear wall 43 of the plasma chamber.

The details of the plasma chamber described so far are common in prior art plasma chambers of the Bernas type.

In the illustrated embodiment, the rear wall 43 of the plasma chamber forms a wall portion which is thermally insulated from the remaining walls of the plasma chamber by a thermally insulating gasket 49. A heat shield 50 is mounted within the enclosed area of the plasma chamber so as to be generally parallel to the rear wall portion 43. The heat shield 50 has an aperture 51 which is located relative to the nozzle 48 to allow feed gas or vapour to pass through into a plasma forming region (indicated generally at 52) within the plasma chamber.

The plasma chamber is operated, by appropriate selection of arc current and other controllable parameters, with an energy density in the plasma sufficient to cause dissociation of the Decaborane feed vapour to produce monatomic boron ions. At such intensity, the walls of the plasma chamber exposed to the plasma are heated to well over 300° C. The heat shield 50 helps reduce the thermal loading on the rear wall portion 43 of the plasma chamber. Further thermal insulation in nozzle 48 ensures that the parts of the nozzle exposed to the Decaborane vapour are kept generally below 300° C., in order to minimise dissociation of the Decaborane vapour, before entry into the plasma-forming region of the plasma chamber through the aperture 51 in the screen 50. To ensure that the feed conduit 47 connected to the nozzle 48 is kept cool, a cooling jacket 53 is provided, so that the feed pipe can be cooled, for example by cooling water flowing through the cooling jacket.

In this way, an arrangement is provided which ensures that the Decaborane vapour is kept below 300° C. until it reaches the plasma-forming region 52. The plasma chamber itself is operated at a sufficient intensity so that the walls of the plasma chamber exposed to the plasma are much hotter than 300° C. to ensure effective dissociation and production of monatomic boron ions.

In the example of the invention described above, the feed vapour is Decaborane, with a view to producing monatomic boron ions for implantation. However, it should be understood that other boranes may be used instead, for example diborane, pentaborane, and octadecaborane.

The invention may also be employed for implantation of other dopants, for example Arsenic (As), Antimony (Sb), Indium (In) and Phosphorus (P). Then, a known cluster species, comprising multiple atoms of the required dopant, is used instead of the Decaborane described in the above example. In each case, the cluster species has a first temperature at which the species has a substantial vapour pressure and a second higher temperature at which the species tends to dissociate. These temperatures are known or can readily be determined empirically. The supply conduit to the plasma chamber should be maintained at a temperature below the second higher temperature, in order to prevent dissociation before entry into the plasma chamber. The dissociation products of the above cluster species tend to have vapour pressures which are much lower, so that on dissociation the product can condense out onto the walls of the feed pipe and the entry nozzle into the plasma chamber. Keeping these regions which contact the cluster species vapour below the temperature at which the species dissociates, minimises this deposition.

However, once inside the plasma chamber within the plasma-forming region, the plasma chamber is operated with sufficient intensity to ensure that the chamber walls are well above the second temperature, to maximise dissociation and the production of the required monatomic ions of the desired dopant.

The structure of plasma chamber and feed conduit illustrated in FIG. 2 is only one example of arrangements which can provide the necessary cooling of the feed conduit and nozzle, while permitting the plasma chamber walls to operate relatively hot. In the FIG. 2 example, a plasma chamber wall portion which is thermally insulated from the containing walls of the plasma chamber is constituted by substantially the entire rear wall 43 of the plasma chamber. However, the insulated wall portion may be restricted to a smaller region immediately around the nozzle 48.

Further, it may be possible to dispense with the heat-shielding plate 50, especially if the rear wall 43 of the plasma chamber is displaced (to the left in FIG. 2) so as to be further from the plasma-forming region 52.

Instead of using thermal insulating material for the gasket 49, insulating the rear wall portion 43, a cooled body may be located around the periphery of the cooled wall portion, to provide the necessary cooling to keep the nozzle and feed conduit below the required temperature.

Throughout the description and claims, reference has been made to a feed "vapour", for example decaborane vapour. Generally, the species containing multiple atoms of desired dopant are available as solids which have a substantial vapour pressure above a relatively low temperature. However, it is intended that the term "vapour" includes feed materials which may be supplied in gaseous form.

Also, the description and claims throughout refer to a plasma supporting "gas", and the two specific examples described, $BF_3$ and Ar are both available as gases. However, it is intended that the term "gas" in this context includes gaseous products of the treatment of solid or liquid materials. For example, a useful supporting "gas" for an arsenic beam would be an arsenic vapour produced by heating solid arsenic in an oven. Similarly, a useful supporting "gas" for a phosphorus beam would be phosphorus vapour produced by heating solid red phosphorus in an oven.

The invention claimed is:

1. A method of providing monatomic ions of a desired dopant for ion implantation, comprising supplying a feed vapour into a plasma chamber, said feed vapour containing a species each comprising a plural number of atoms of the desired dopant, generating a plasma in said plasma chamber having a sufficient energy density to disassociate said species to produce monatomic ions of said desired dopant in the plasma, wherein a plasma supporting gas, different from said feed vapour, is supplied at least initially when the plasma is first established in the plasma chamber, the rate of supply of the supporting gas being reduced when the plasma chamber reaches a desired temperature.

2. A method as claimed in claim 1, wherein the supporting gas is replaced by said feed vapour at said desired temperature.

3. A method as claimed in claim 1, wherein the plasma supporting gas is maintained simultaneously with said feed vapour, at least for an initial period.

4. A method as claimed in claim 1, wherein the supporting gas is $BF_3$.

5. A method as claimed in claim 1, wherein the supporting gas is Ar.

6. A method as claimed in claim 1, wherein said species comprises plural atoms of one of B, As, Sb, In and P.

7. A method as claimed in claim 1, wherein said species is $B_xH_y$, where x∃2.

8. A method as claimed in claim 7, wherein the species is decarborane ($B_{10}H_{14}$).

9. A method as claimed in claim 8, wherein the decaborane vapour is kept below 300° C. before entering the plasma chamber.

10. A method as claimed in claim 8, wherein the plasma chamber is operated at a temperature above 300° C.

11. A method as claimed in claim 10, wherein the plasma chamber is operated at a temperature above said second predetermined temperature.

12. A method as claimed in claim 1, wherein ions are extracted from the plasma chamber and mass selected to form a beam of said monatomic ions.

13. A method as claimed in claim 1, wherein said species is one that has a substantial vapour pressure above a first predetermined temperature and dissociates above a second predetermined temperature higher than said first predetermined temperature, and wherein the feed vapour is maintained below said second predetermined temperature before entering the plasma chamber.

14. A source of monatomic ions of a desired dopant for an ion implanter, comprising a plasma chamber, a feed vapour supply, said feed vapour containing a species each comprising a plural number of atoms of the desired dopant, a supply of a plasma supporting gas, other than said feed vapour, an energy supply to said plasma chamber to form a plasma therein having an energy density sufficient to dissociate said species to produce monatomic ions of said desired dopant, and a controller to control said feed vapour supply and said supporting gas supply to supply said supporting gas at least initially when the plasma is first established in the plasma chamber and to reduce the rate of supply of the supporting gas when the plasma chamber reaches a desired temperature.

15. A source of monatomic ions as claimed in claim 14, wherein said supporting gas supply provides a supply of $BF_3$.

16. A source of monatomic ions as claimed in claim 14, wherein said supporting gas supply provides a supply of Ar.

17. A source of monatomic ions as claimed in claim 14, wherein said species comprises plural atoms of one of B, As, Sb, In and P.

18. A source of monatomic ions as claimed in claim 17, wherein said species is $B_xH_y$, where x∃2.

19. A source of monatomic ions as claimed in claim 14, wherein said species is one that has a substantial vapour pressure above a first predetermined temperature and dissociates above a second predetermined temperature higher than said first predetermined temperature, and wherein said feed vapour supply includes a feed conduit, having a portion connected to said plasma chamber, for supplying said feed vapour to said plasma chamber, and a cooler associated with said feed conduit to maintain said feed conduit including said portion connected to said plasma chamber below said second predetermined temperature.

20. A source of monatomic ions as claimed in claim 19, wherein said energy supply and said plasma chamber are arranged to be operable so that the plasma chamber is above said second predetermined temperature.

21. A source of monatomic ions as claimed in claim 19, wherein said species is decaborane ($B_{10}H_{14}$), and said cooler is operative to maintain said feed conduit below 300° C.

22. A source of monatomic ions as claimed in claim 14, wherein said plasma chamber has an extraction aperture, and the source includes a biased electrode to extract ions from the chamber and a mass selector to form a beam of said monatomic ions from the extracted ions.

23. A method of providing monatomic ions of a desired dopant for ion implantation, comprising supplying a feed vapour into a plasma chamber, said feed vapour containing a species each comprising a plural number of atoms of the desired dopant, generating a plasma in said plasma chamber having a sufficient energy density to dissociate said species to produce monatomic ions of said desired dopant in the plasma, extracting ions from the plasma chamber using biased electrodes to form a beam of extracted ions, directing the beam of extracted ions into a mass analyzer, controlling the mass analyzer to select substantially only monatomic ions of said dopant from the beam of extracted ions to form a continuing beam of substantially only said monatomic ions, and transmitting the continuing beam of substantially only said monatomic ions to a substrate to be implanted therein.

24. A method as claimed in claim 23, wherein the plasma chamber is a cathode arc type plasma chamber and energy is delivered to maintain the plasma in the chamber from an arc supply.

25. A method as claimed in claim 23, wherein the energy to generate the plasma in the plasma chamber is derived from one of radio frequency and microwave sources.

26. A method as claimed in claim 23, wherein said species comprises plural atoms of one of B, As, Sb, In and P.

27. A method as claimed in claim 26, wherein said species is $B_xH_y$, where x∃2.

28. A source of monatomic ions of a desired dopant for an ion implanter, comprising a plasma chamber, a feed vapour supply, said feed vapour containing a species each comprising a plural number of atoms of the desired dopant, said species being one that has a substantial vapour pressure above a first predetermined temperature and dissociates above a second predetermined temperature higher than said first predetermined temperature, said feed vapour supply including a feed conduit having a portion, connected to said plasma chamber, for supplying said feed vapour to said plasma chamber, and a cooler associated with said feed conduit to maintain said feed conduit including said portion connected to said plasma chamber below said second predetermined temperature, and an energy supply to said plasma chamber to form a plasma therein having an energy density sufficient to dissociate said species to produce monatomic ions of said desired dopant, said energy supply and said plasma chamber being arranged to be operable so that the plasma chamber is above said second predetermined temperature.

29. A source of monatomic ions as claimed in claim 28, wherein said species is $B_xH_y$ where x∃2.

30. A source of monatomic ions as claimed in claim 28, wherein said plasma chamber comprises containing walls and a wall portion having a feed vapour entry nozzle, and said feed conduit is connected to supply feed vapour through said nozzle into the plasma chamber, said wall portion being thermally insulated from said containing walls.

31. A source of monatomic ions as claimed in claim 30, wherein the plasma chamber has a plasma forming region and includes an internal thermal screen mounted between said wall portion and the plasma forming region to reduce heating of said wall portion during operation, said internal thermal screen having an aperture located relative to said nozzle such that feed vapour can pass into said plasma forming region.

32. A method of providing monatomic ions of a desired dopant for ion implantation, comprising supplying a feed vapour into a plasma chamber, wherein said species is one that has a substantial vapour pressure above a first predetermined temperature and dissociates above a second predetermined temperature higher than said first predetermined temperature, and generating a plasma in said plasma chamber having sufficient energy density to dissociate said species to produce monatomic ions of said desired dopant in the plasma, wherein the feed vapour is maintained below said second predetermined temperature before entering the plasma chamber and the plasma chamber is operated at a temperature above said second predetermined temperature.

33. A method as claimed in claim 32, wherein said species is $B_xH_y$, where x∃2.

* * * * *